United States Patent [19]

Ishikawa et al.

[11] Patent Number: 4,647,815

[45] Date of Patent: Mar. 3, 1987

[54] RESISTORS FOR USE IN CATHODE RAY TUBES

[75] Inventors: Yoshirou Ishikawa, Kanagawa; Kazuyuki Ohta, Chiba; Shinobu Mitsuhashi, Tokyo, all of Japan

[73] Assignee: Sony Corporation, Tokyo, Japan

[21] Appl. No.: 717,809

[22] Filed: Mar. 29, 1985

[30] Foreign Application Priority Data

Apr. 6, 1984 [JP] Japan ..... 59-68862

[51] Int. Cl.[4] ..... H01J 23/16

[52] U.S. Cl. ..... 315/3; 313/449

[58] Field of Search ..... 315/3; 313/365, 366, 313/331, 370, 449, 414

[56] References Cited

U.S. PATENT DOCUMENTS 3,749,961 7/1973 Bates et al. ..... 315/3

4,349,767 9/1982 Muramoto et al. ..... 315/3

4,488,085 12/1984 Nakamura et al. ..... 315/3

*Primary Examiner*—James C. Yeung

*Attorney, Agent, or Firm*—Hill, Van Santen, Steadman & Simpson

[57] ABSTRACT

A resistor for use in a cathode ray tube comprises an insulating plate provided thereon with at least first and second electrode terminals for use respectively with relatively high and low voltages in the cathode ray tube, a coating insulator provided on the insulating plate for covering the same, and a resistive layer provided in a predetermined pattern on the insulating plate between first and second electrode terminals to be covered by the coating insulator and accompanied with a piece of conductive layer provided on the insulating plate at an area between first and second electrode terminals including a high potential difference position where a relatively large potential difference is applied to the coating insulator when the resistor is used in the cathode ray tube.

6 Claims, 7 Drawing Figures

RESISTORS FOR USE IN CATHODE RAY TUBES

BACKGROUND OF THE INVENTION

1. Field of the Invention

The present invention relates generally to resistors for dividing an anode voltage to produce at least one relatively high voltage in cathode ray tubes, and more particularly, to a resistor used in combination with an electron gun assembly in a cathode ray tube for breeding from the anode voltage of the cathode ray tube a relatively high voltage required to be applied to the electrode of the electron gun assembly.

2. Description of the Prior Art

There has been proposed a color cathode ray tube used in a color television receiver in which relatively high voltages are required to be supplied to convergence electrodes for converging a plurality of electron beams at a screen, focus electrodes for focusing each of the electron beams on the screen and so on, in addition to an anode voltage. In such a color cathode ray tube, a resistor is used in combination with an electron gun assembly containing the convergence electrodes, focus electrodes and other electrodes for the purpose of dividing the anode voltage to breed the relatively high voltages supplied to the respective electrodes.

A previously proposed resistor for use in the color cathode ray tube in the manner as mentioned above is shown in FIGS. 1 and 2. FIG. 1 is a plane view showing a resistor 7 previously proposed with a major part thereof shown through a coating insulator forming an exterior portion, and FIG. 2 is a side view showing the resistor 7 entirely. The resistor 7 has an insulating plate 1 made of, for example, ceramics and provided with a plurality of terminals formed by separate conductive layers put on the surface thereof, respectively. These terminals contain an anode electrode terminal 2 for being supplied with the anode voltage, a convergence electrode terminal 3 for delivering the relatively high voltage supplied to the convergence electrodes, that is, a convergence voltage, and an earth electrode terminal 4. Then, a voltage dividing resistive layer 5 is also provided on the surface of the insulating plate 1. This voltage dividing resistive layer 5 comprises a partial resistive layer **5*a* formed in the zigzag pattern with a predetermined resistance to connect the convergence electrode terminal 3 with the earth electrode terminal 4, another partial resistive layer 5*b* formed in the zigzag pattern also with a predetermined resistance to connect the anode electrode terminal 2 with the convergence electrode terminal 3, and an adjusting resistive layer 5*c* provided to couple the convergence electrode terminal 3 with the partial resistive layers 5*a* and 5*b*. The resistance between the convergence electrode terminal 3 and the earth electrode terminal 4 and the resistance between the anode electrode terminal 2 and the convergence electrode terminal 3 can be adjusted by removing the adjusting resistive layer 5*c* partially in the manufacturing process of the resistor 7. Further, at the hatched portion on the insulating plate 1, a coating insulator 6 of, for example, flint glass is provided to cover the voltage dividing resistive layer 5**.

The resistor 7 thus constituted is used in a color cathode ray tube in such a manner as illustrated in FIG. 3. In FIG. 3, an electron gun assembly 9 is disposed in a neck portion **8*a* of a body of tube 8 of the color cathode ray tube, and has three cathodes K, an arrangement of a first grid electrode G1, a second grid electrode G2, a third grid electrode G3, a fourth grid electrode G4 and a fifth grid electrode G5 aligned in common to the three cathodes K, and convergence electrodes 10 provided next to the fifth grid electrode G5. The first to fifth grid electrodes Gl to G5 and the convergence electrodes 10 are connected mechanically with a beading glass 11 to be supported in common thereby, and the third and fifth grid electrodes G3 and G5 are coupled electrically with each other through a conductive wire 13. The convergence electrodes 10 comprises a pair of inner deflecting electrode plates 10*a* and 10*b* faced to each other and connected electrically to the fifth grid electrode G5 through a conducting plate 14 and a pair of outer deflecting electrode plates 10*c* and 10*d* provided to face to the inner deflecting electrode plates 10*a* and 10*b***, respectively.

The resistor 7 as shown in FIGS. 1 and 2 is attached to the electron gun assembly 9 with the anode electrode terminal 2 connected through a conductive connecting piece 12 to the fifth grid electrode G5. On the inner surface of a funnel portion **8*b* of the body of tube 8, a graphite coating 15 is provided to extend to the inner surface of the neck portion 8*a*, and the anode voltage is applied through a high voltage supplying button, that is, an anode button (not shown in Figs.) built in the funnel portion 8*b* to the graphite coating 15. The conducting plate 14 is provided with conductive springs 16 which come into contact with the graphite coating 15 so that the anode voltage is supplied to the fifth grid electrode G5, the third grid electrode G3, the inner deflecting electrode plates 10*a* and 10*b* of the convergence electrodes 10 and the anode electrode terminal 2 of the resistor 7. The convergence electrode terminal 3 of the resistor 7 is connected through a conductive connecting piece 17 to the outer deflecting electrode plates 10*c* and 10*d* of the convergence electrodes 10 and the earth electrode terminal 4 of the resistor 7 is connected with an earth electrode terminal pin 19 fixed through a stem portion 18 at the end of the neck portion 8*a* of the body of tube 8 to be grounded directly or through a variable resistor provided in the outside of the body of tube 8, so that the convergence voltage obtained at the convergence electrode terminal 3 as a result of the division of the anode voltage by the partial resistive layers 5*a* and 5*b* is supplied to the outer deflecting electrode plates 10*c* and 10*d* of the convergence electrodes 10**.

In the color cathode ray tube containing the electron gun assembly 9 and the resistor 7 therein as mentioned above, if the electron gun assembly 9 has sharp-pointed projections thereon, undesirable electric discharge may occur at some of the sharp-pointed projections in actual use. Accordingly, the color cathode ray tube is subjected to the knocking treatment in the manufacturing process thereof in which such portions as the sharp-pointed projections on the electron gun assembly 9 where electric discharge is likely to occur are caused positively to have electric discharge thereat previously to be reformed with melting away, for the purpose of stabilizing the operation thereof in practical use. In the knocking treatment, the third and fifth grid electrodes G3 and G5 of the electron gun assembly 9 and the anode electrode terminal 2 of the resistor 7 are supplied with a high voltage (knocking voltage) which is twice to third times as high as the anode voltage in the practical use of the color cathode ray tube, and the first, second and fourth grid electrodes Gl, G2 and G4 are grounded.

In the situation of such knocking treatment, the outer surface of the coating insulator 6 forming the exterior of the resistor 7 is electrically charged to be at relatively high potential except for a certain part thereof, and the coating insulator 6 is applied a voltage higher than that in the practical use of the cathode ray tube, particularly on the low voltage side of the partial resistive layer 5*a*. FIG. 4 shows the potential on the outer surface of the coating insulator 6 and the potential on the partial resistive layer 5*a* provided between the earth electrode terminal 4 and the convergence electrode terminal 3 under the knocking treatment with curves a and b, respectively, and further the difference between the potentials shown with the curves a and b, respectively, with a curve c in the graphic illustration having the axis of ordinates representing voltage V and the axis of abscissas representing distance L measured on the surface of the insulating plate 1 from the earth electrode terminal 4 toward the convergence electrode terminal 3 of the resistor 7 and shown with reference to the resistor 7 and the electron gun assembly 9. As apparent from this illustration in FIG. 4, the potential difference between the partial resistive layer 5*a* and the outer surface of the coating insulator 6 reaches the maximum at a position P close to the third grid electrode G3 supplied with the knocking voltage on the low voltage side of the partial resistive layer 5*a*, and therefore, the maximum voltage is applied to the coating insulator 6 at the position P. Consequently, it is feared that a voltage exceeding the upper limit of the resistible voltage for the coating insulator 6 is applied to the coating insulator 6 at the position around the third grid electrode G3 of the electron gun assembly 9 so as to bring deterioration in dielectric strength or dielectric breakdown on the coating insulator 6 and, as a result, the partial resistive layer 5*a* is damaged to vary its resistance conspicuously.

Against such variations in the resistance of partial resistive layer 5*a* resulting from the deterioration in dielectric strength or dielectric breakdown brought on the coating insulator 6 as mentioned above, it may be advantageous that the coating insulator 6 is given an increased thickness to have raised dielectric strength. That is, it is possible to prevent the deterioration in dielectric strength or dielectric breakdown from being brought on the coating insulator 6 and thereby to restrain the variations in the resistance of partial resistive layer 5*a* by means of making the coating insulator 6 have an increased thickness.

However, it is disadvantageous for the production cost of the resistor 7 to increase the thickness of the coating insulator 6 indiscreetly. Further, the coating insulator 6 with the increased thickness may cause the problem that the resistor 7 is undesirably warped due to difference in the coefficient of thermal expansion between the insulating plate 1 and the coating insulator 6, and the coating insulator 6 comes to exfoliate from the insulating plate 1 or comes to be cracked through the repetition of an increase in temperature of the resistor 7 in the operative state and a decrease in temperature of the resistor 7 in the inoperative state occurring alternately. This results in that the reliability of the resistor 7 is lowered.

OBJECTS AND SUMMARY OF THE INVENTION

Accordingly, it is an object of the present invention to provide a resistor for use in a cathode ray tube which avoids the foregoing disadvantage and problem of the prior art.

Another object of the present invention is to provide a resistor for use in a cathode ray tube which is formed with a resistive layer put in a predetermined pattern on an insulating plate and a coating insulator covering the resistive layer, and which can restrain variations in the resistance of the resistive layer in its entirety through the knocking treatment to which a cathode ray tube employing the resistor is subjected, without increasing the production cost and lowering the reliability.

A further object of the present invention is to provide a resistor for use in a cathode ray tube which is formed with a resistive layer put in a predetermined pattern on an insulating plate and a coating insulator covering the resistive layer, and which can effectively restrain variations in the resistance of the resistive layer at an area including a high potential difference position where a relatively large potential difference is applied to the coating insulator in the use of the resistor in the cathode ray tube, through the knocking treatment to which a cathode ray tube employing the resistor is subjected, without increasing the thickness of the coating insulator.

In accordance with an aspect of the present invention, there is provided a resistor for use in a cathode ray tube comprising an insulating plate having a surface on which at least first and second electrode terminals for being used respectively with relatively high and low voltages are fixed, a coating insulator provided on the surface of the insulating plate for covering the same, and a resistive layer provided in a predetermined pattern on the surface of the insulating plate between the first and second electrode terminals to be covered by the coating insulator and accompanied with a piece of conductive layer provided on the insulating plate at an area between the first and second electrode terminals including a high potential difference position where a relatively large potential difference is applied to the coating insulator when the resistor is used in the cathode ray tube.

In an embodiment of resistor according to the present invention taken by way of example, the resistive layer on the insulating plate is formed to be continuous in a predetermined pattern between the first and second electrode terminals, and the conductive layer is put on the resistive layer at the area including the high potential difference position.

In another embodiment, the resistive layer on the insulating plate is formed to have two separate portions connected at one ends thereof to the first and second electrode terminals, respectively, and the conductive layer is located between these two separate portions of the resistive layer to couple them therethrough at the area including the high potential difference position.

With the resistor thus constituted in accordance with the present invention, the resistive layer is substantially prevented by the conductive layer provided for accompanying therewith from having variations in its resistance at the area including the high potential difference position where a particularly large potential difference is applied to the coating insulator in such a situation as the knocking treatment to which the cathode ray tube employing the resistor is subjected, and consequently variations in the resistance of the resistive layer in its entirety is effectively restrained.

The above, and other objects, features and advantages of the present invention will be apparent from the following detailed description which is to be read in conjunction with the accompanying drawings.

DETAILED DESCRIPTION OF THE PREFERRED EMBODIMENTS

Now, embodiments of resistor for use in a cathode ray tube according to the present invention will be described with reference to the accompanying drawings hereinafter.

Figure 1:
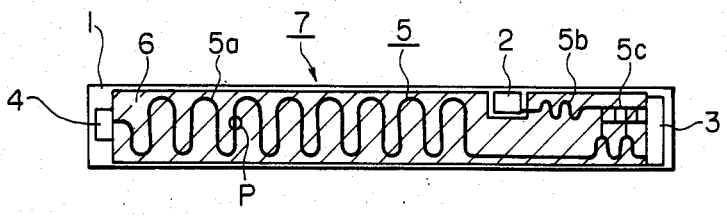
FIGS. 1 and 2 are plane and side views showing a previously proposed resistor for use in a cathode ray tube, respectively.
Figure 5:
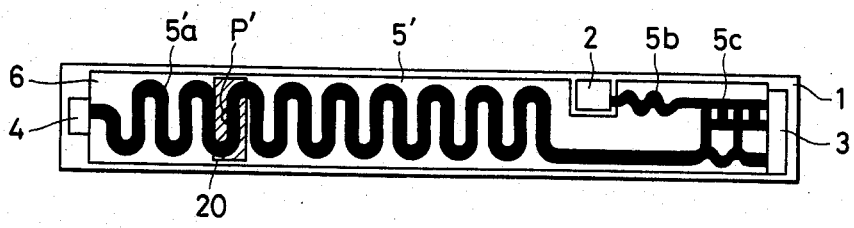
FIG. 5 is a plane view showing an embodiment of resistor for use in a cathode ray tube according to the present invention.

FIG. 5 shows an example of the resistor according to the present invention with a major part thereof viewed through a coating insulator forming an exterior portion, in the same manner as FIG. 1. In FIG. 5, elements and parts corresponding to those of FIGS. 1 and 2 are marked with the same references and further description thereof will be omitted.

Figure 2:
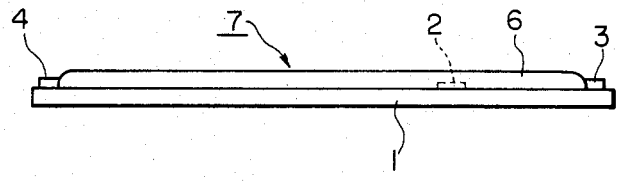

In this example of the resistor according to the present invention, a voltage dividing resistive layer 5' which is provided on the surface of the insulating plate 1 and covered by the coating insulator 6 of flint glass comprises a partial resistive layer **5'*a* formed to be continuous in the zigzag pattern between the convergence electrode terminal 3 and the earth electrode terminal 4 and accompanied with a piece of conductive layer 20, the partial resistive layer 5*b* formed also in the zigzag pattern to couple the anode electrode terminal 2 with the convergence electrode terminal 3 and the adjusting resistive layer 5*c* provided to couple the convergence electrode terminal 3 with the partial resistive layers 5'*a* and 5*b*, in the similar manner as the resistor shown in FIGS. 1 and 2. The conductive layer 20 is formed by, for example, sintering a kind of ruthenium oxide paste with extremely low specific resistance and put on a portion of the partial resistive layer 5'*a***.

Figure 3:
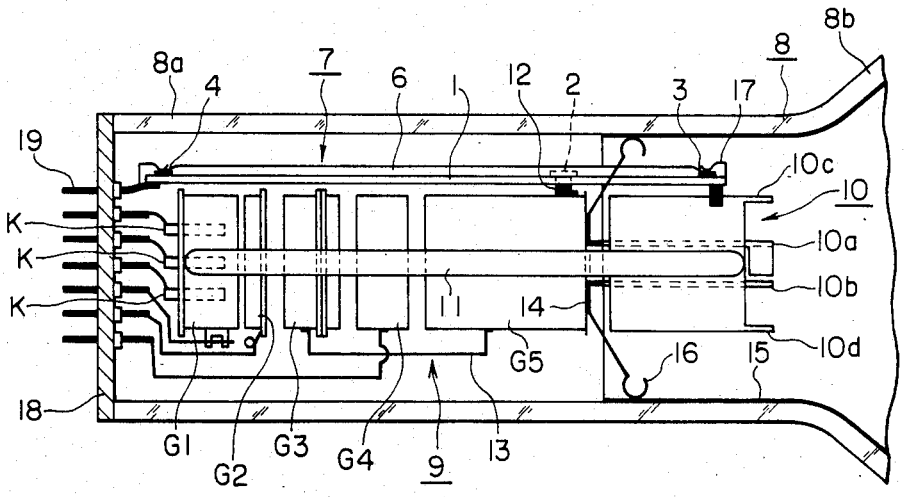
FIG. 3 is a schematic side view showing a portion of a cathode ray tube employing the resistor shown in FIGS. 1 and 2.
Figure 4:
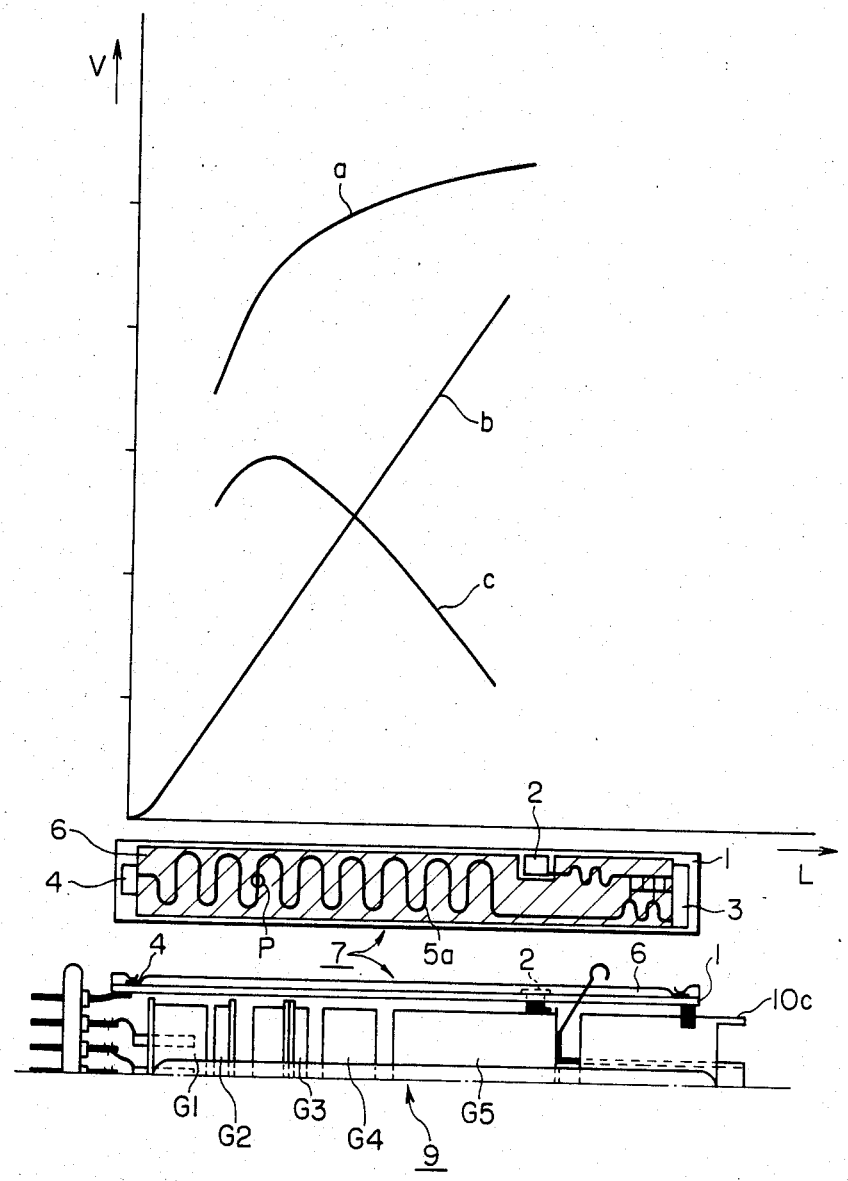
FIG. 4 is an illustration used for explanation of the potential relation on the resistor employed in the cathode ray tube shown in FIG. 3.

The voltage dividing resistive layer 5' is made of substantially homogeneous resistive material, for example, resistive material obtained by sintering a kind of ruthenium oxide paste with relatively high specific resistance, with a substantially constant sectional area. The partial resistive layer **5'*a* is formed in the zigzag pattern with a substantially constant meandering width in its entirety and provided thereon with the conductive layer 20 which extends to cover an area on the insulating plate 1 including a position P' which corresponds to the position P in the resistor 7 shown in FIGS. 1, 2 and 4. The position P' is provided at a location where the potential difference between the partial resistive layer 5'*a* and the outer surface of the coating insulator 6 reaches the maximum, and accordingly the maximum potential difference is applied to the coating insulator 6, when the resistor is used in combination with the electron gun assembly 9 in the color cathode ray tube as shown in FIG. 3 and supplied with the anode voltage to the anode electrode terminal 2**. (The position P' is referred to as the maximum potential difference position, hereinafter.)

In the voltage dividing resistive layer 5' thus provided on the insulating plate 1 to contain the partial resistive layer **5'*a* accompanied with the conductive layer 20, the portion of the partial resistive layer 5'*a* in the area covered by the conductive layer 20** does not function as a resistive layer substantially.

Figure 6:
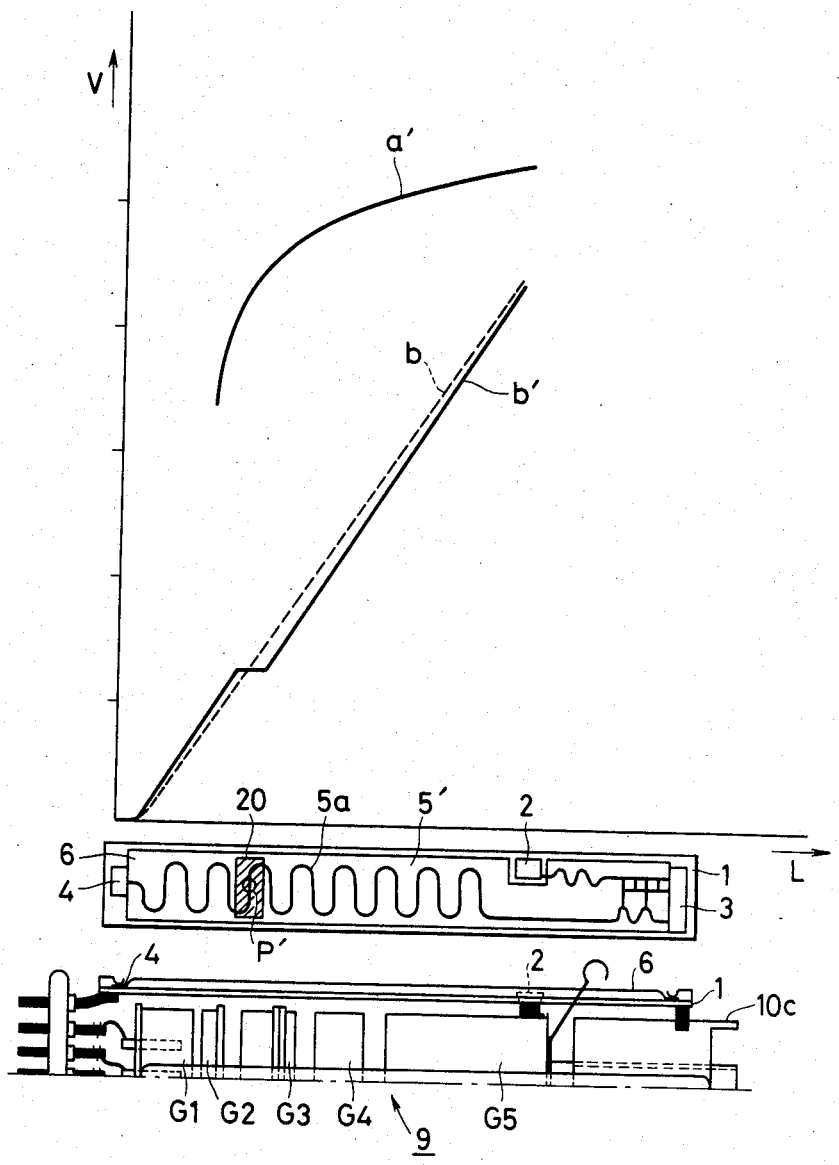
FIG. 6 is a plane view showing another embodiment of resistor for use in a cathode ray tube according to the present invention.

Accordingly, in the case where the resistor shown in FIG. 5 is employed in combination with the electron gun assembly 9 in the color cathode ray tube as shown in FIG. 3 in the same manner as the resistor 7 previously proposed, and the knocking voltage and the earth potential are supplied to the anode electrode terminal 2 and the earth electrode terminal 4, respectively, under the knocking treatment to which the color cathode ray tube is subjected, the potential on the partial resistive layer **5'*a* having the portion provided thereon with the conductive layer 20 varies with a constant level at the area including the maximum potential difference position P' and covered by the conductive layer 20, as shown with a curve b' in the graphic illustration having the axis of ordinates representing voltage V and the axis of abscissas representing distance L measured on the surface of the insulating plate 1 from the earth electrode terminal 4 toward the convergence electrode terminal 3 shown in FIG. 6, in the different manner from the corresponding potential variation on the resistor 7 previously proposed which is shown with a broken curve b in the graphic illustration of FIG. 6. Further, the potential on the outer surace of the coating insulator 6 in this case has such variation as shown with a curve a' in the graphic illustration of FIG. 6**.

As described above, in the case of the resistor shown in FIG. 5, the partial resistive layer **5'*a* is covered by the conductive layer 20 at the area including the maximum potential difference position P' where the potential difference applied to the coating insulator 6 is apt to bring deterioration in dielectric strength or dielectric breakdown on the coating insulator 6 under the knocking treatment to which the color cathode ray tube employing the resistor shown in FIG. 5 is subjected, and when the deterioration in dielectric strength or dielectric breakdown is brought on the coating insulator 6 at the area including the maximum potential difference position P', the partial resistive layer 5'*a* is protected by the concuctive layer 20 so as not to suffer substantially the adverse influence of the deterioration in dielectric strength or dielectric breakdown brought on the coating insulator 6. Accordingly, the partial resistive layer 5'*a* is substantially prevented from having variations in its resistance at the area including the maximum potential difference position P' so that variations in the resistance of the partial resistive layer 5'*a*** in its entirety is effectively restrained.

Figure 7:
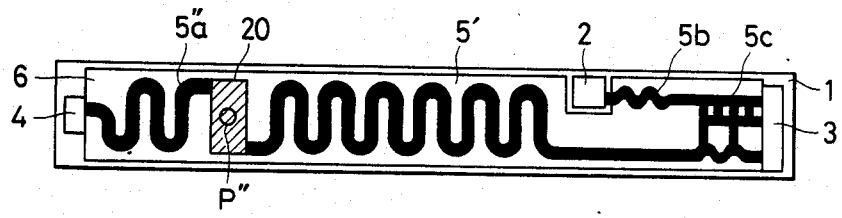
FIG. 7 is an illustration used for explanation of the potential relation on the resistor shown in FIG. 5.

FIG. 7 shows another example of the resistor according to the present invention in the same manner as the example shown in FIG. 5. In FIG. 7 also, elements and parts corresponding to those of FIGS. 1 and 2 are marked with the same references and further description thereof will be omitted.

In this example, a partial resistive layer **5''*a* is provided on the insulating plate 1 to be formed in the zigzag pattern in its entirety between the convergence electrode terminal 3 and the earth electrode terminal 4 and accompanied with the conductive layer 20, in addition to the partial resistive layer 5***b* and the adjusting resistive layer 5*c* provided on the insulating plate 1 in the same manner as the resistor shown in FIG. 5. The partial resistive layer 5′*a* is composed of two separate portions, one of which is connected to the convergence electrode terminal 3 at one end thereof and the other of which is connected to the earth electrode terminal 4 at one end thereof. Between these two portions of the partial resistive layer 5″*a*, the conductive layer 20 is attached directly to the insulating plate 1 to couple therethrough two portions with each other. The location of the conductive layer 20 is so selected that the conductive layer 20 covers an area including a position P″ which corresponds to the maximum potential difference position P′ in the resistor shown in FIG. 5.

Accordingly, in the case where the resistor shown in FIG. 7 is employed in combination with the electron gun assembly 9 in the color cathode ray tube as shown in FIG. 3, the partial resistive layer 5′*a* is also prevented substantially by the conductive layer 20 from having variations in its resistance at the area including the position P″ in the same manner as the partial resistive layer 5′*a* of the resistor shown in FIG. 5 when the deterioration in dielectric strength or dielectric breakdown is brought on the coating insulator 6 at the area including the position P″.

As apparent from the above description, in the resistor according to the present invention, the conductive layer, which is provided to accompany with the resistive layer on the insulating plate at the area including a high potential difference position where a relatively large potential difference is applied to the coating insulator covering the resistive layer when the first and second electrode terminals on the insulating plate are used with the relatively high and low voltages respectively in practice, is operative to make the resistive layer hard to suffer an adverse influence of deterioration in dielectric strength or dielectric breakdown caused on the coating insulator under the knocking treatment to which a cathode ray tube employing the resistor is subjected, and consequently the resistance of the resistive layer is prevented from varying conspicuously at the area including the high potential difference position through the knocking treatment, so that variations in the resistance of the resistive layer in its entirety is effectively restrained.

Further, since a coating insulator of increased thickness is not used, the resistor according to the present invention is prevented from being undesirably warped due to difference in the coefficient of the thermal expansion between the insulating plate and the coating insulator and from being troubled by the coating insulator exfoliating from the insulating plate or being cracked, and can be manufactured at relatively low cost.

What is claimed is:

1. A resistor for use in a cathode ray tube comprising:

an insulating plate provided thereon with at least first and second electrode terminals for use respectively with relatively high and low voltages in the cathode ray tube, a coating insulator provided on said insulating plate for covering the same, and a resistive layer provided in a predetermined pattern on said insulating plate between said first and second electrode terminals to be covered by said coating insulator, said resistive layer being accompanied with a piece of conductive layer provided on said insulating plate at an area between said first and second electrode terminals including a high potential difference position where a relatively large potential difference is applied to said coating insulator in the use of said resistor in the cathode ray tube, said conductive layer being entirely covered by said coating insulator and thereby insulated from other circuits.

2. A resistor according to claim 1, wherein said resistive layer is formed to be continuous in a predetermined pattern to couple therethrough said first and second electrode terminals, and said conductive layer is put on said resistive layer at the area including said high potential difference position.

3. A resistor according to claim 2, wherein said resistive layer is made of substantially homogeneous resistive material and formed in the zigzag pattern.

4. A resistor according to claim 1, wherein said resistive layer is formed to have two separate portions connected to said first and second electrode terminals, respectively, and said conductive layer is located between said two separate portions of the resistive layer to couple them therethrough at the area including said high potential difference position.

5. A resistor according to claim 4, wherein said conductive layer is attached directry to said insulating plate.

6. A resistor according to claim 1, wherein said resistive layer is made of resistive material obtained by sintering a kind of ruthenium oxide paste with relatively high specific resistance and said conductive layer is formed by sintering another kind of ruthenium oxide paste with extremely low specific resistance.

* * * * .*